US011608805B2

(12) United States Patent
Schoefbaenker et al.

(10) Patent No.: US 11,608,805 B2
(45) Date of Patent: Mar. 21, 2023

(54) DEVICE FOR CONTROLLING AN INJECTOR

(71) Applicant: LIEBHERR-COMPONENTS DEGGENDORF GMBH, Deggendorf (DE)

(72) Inventors: Norbert Schoefbaenker, Ohlsdorf (AT); Verena Koegel, Ortenburg (DE)

(73) Assignee: LIEBHERR-COMPONENTS DEGGENDORF GMBH, Deggendorf (DE)

( * ) Notice: Subject to any disclaimer, the term of this patent is extended or adjusted under 35 U.S.C. 154(b) by 587 days.

(21) Appl. No.: 16/632,527

(22) PCT Filed: Jul. 20, 2018

(86) PCT No.: PCT/EP2018/069838
§ 371 (c)(1),
(2) Date: May 6, 2020

(87) PCT Pub. No.: WO2019/016399
PCT Pub. Date: Jan. 24, 2019

(65) Prior Publication Data

US 2020/0271080 A1 Aug. 27, 2020

(30) Foreign Application Priority Data

Jul. 20, 2017 (DE) ..... 10 2017 116 367

(51) Int. Cl.
*F02M 63/00* (2006.01)
*F02M 47/02* (2006.01)

(52) U.S. Cl.
CPC ..... *F02M 63/0045* (2013.01); *F02M 47/027* (2013.01); *F02M 63/0075* (2013.01); *F02M 63/0078* (2013.01)

(58) Field of Classification Search
CPC ..... F02M 47/027; F02M 63/0045; F02M 63/0056; F02M 63/0075; F02M 63/0078; F02M 2200/28
(Continued)

(56) References Cited

U.S. PATENT DOCUMENTS

2004/0178283 A1* 9/2004 Boehland ..... F02M 63/0045 123/446
2009/0065614 A1* 3/2009 Ganser ..... F02M 63/0029 239/584
(Continued)

FOREIGN PATENT DOCUMENTS

CN 102207051 A 10/2011
DE 19823937 A1 12/1999
(Continued)

OTHER PUBLICATIONS

ISA European Patent Office, International Search Report Issued in Application No. PCT/EP2018/069838, dated Oct. 9, 2018, WIPO, 6 pages.
(Continued)

*Primary Examiner* — Cody J Lieuwen
(74) *Attorney, Agent, or Firm* — McCoy Russell LLP

(57) ABSTRACT

Device for controlling an injector, including a passage space which can be closed off on one of its two sides by an armature element in order to thereby optionally separate a fluid high-pressure region from a fluid low-pressure region of the injector, a control space for applying a variable pressure to an injector component, preferably an injector needle, a valve which is arranged between another of the two sides of the passage space and the control space, a first connection which connects the high-pressure region of the injector to the passage space, and a second connection which connects the passage space to the control space, wherein the valve is configured to establish a direct connection between
(Continued)

the high-pressure region and the control space if the pressure level in the passage space is equal to or higher than a predetermined value.

19 Claims, 6 Drawing Sheets

(58) Field of Classification Search
USPC ..... 239/583–585.5
See application file for complete search history.

(56) References Cited

U.S. PATENT DOCUMENTS

| | | | |
|---|---|---|---|
| 2010/0039319 | A1 | 2/2010 | Cameron |
| 2010/0103260 | A1 | 4/2010 | Williams |
| 2015/0329333 | A1 | 11/2015 | Fenker et al. |
| 2016/0031680 | A1 | 2/2016 | Deplace |

FOREIGN PATENT DOCUMENTS

| | | | | | |
|---|---|---|---|---|---|
| DE | 102012209841 | A1 | | 12/2013 | |
| DE | 102015113980 | A1 | * | 3/2016 | ..... F02M 47/027 |
| DE | 102015113980 | A1 | | 3/2016 | |
| EP | 1607619 | A2 | | 12/2005 | |
| EP | 2628940 | A1 | | 8/2013 | |
| EP | 3150839 | A1 | | 4/2017 | |
| WO | 03004857 | A1 | | 1/2003 | |
| WO | 2005121545 | A1 | | 12/2005 | |
| WO | 2007098621 | A1 | | 9/2007 | |
| WO | 2016026595 | A1 | | 2/2016 | |

OTHER PUBLICATIONS

State Intellectual Property Office of People's Republic of China, Office Action and Search Report Issued in Application No. 201880048538.6, dated Jun. 30, 2021, 18 pages. (Submitted with Partial Translation).

* cited by examiner

DEVICE FOR CONTROLLING AN INJECTOR

CROSS-REFERENCE TO RELATED APPLICATIONS

The present application is a U.S. National Phase of International Patent Application Serial No. PCT/EP2018/069838 filed on Jul. 20, 2018. International Patent Application Serial No. PCT/EP2018/069838 claims priority to German Patent Application No. 10 2017 116 367.0 filed on Jul. 20, 2017. The entire contents of each of the above-referenced applications are hereby incorporated by reference for all purposes.

TECHNICAL FIELD

The present invention relates to a device for controlling an injector that can, for example, be used as a fuel injection valve.

BACKGROUND AND SUMMARY

In internal combustion engines such as diesel engines or also gasoline engines a fuel is as a rule injected via an injector into a combustion chamber in a specific quantity and for a specific time period. It is a challenge in this respect due to the very short injection periods, that are in the microsecond range, to determine the exact quantity of the fuel to be injected by the injector. There is also the continuous effort here to reduce the space taken up by an injector to reduce the dimensions of an internal combustion engine overall.

The basic function of an injector, that will be looked at in more detail in aspects in the following, is helpful for the understanding of the invention. An injector has a jet needle (also: injector needle) that allows a highly pressurized fuel to exit outwardly on release of a discharge hole of the injector. This jet needle acts in cooperation with this outlet opening as a plug that enables an exit of the fuel when raised. It is therefore accordingly necessary to extend this needle for relatively short time intervals and to allow it to slide back into the outlet opening after a brief period. Hydraulic servo valves that are controlled by electromagnetic valves are used for the triggering of the movement of this jet needle. The servo valves are required for the controlled opening and closing of the jet needle. It is thereby possible to determine the injection start, the injection duration, and the injection end.

Due to the high injection pressures of more than 2500 bar, it is not possible to control (=to move) the jet needle directly with the aid of a magnetic valve. The required forces for opening and closing the jet needle would be too great here so that such a process would only be able to be implemented with the aid of very large electromagnets. Such a design is, however, excluded due to the only limited available installation space in an engine.

So-called servo valves that control the jet needle and are themselves controlled via an electromagnetic valve are typically used instead of the direct control. In this respect, a pressure level that acts on the jet needle in the closure direction is built up in a control space interacting with the jet needle with the aid of the available highly compressed fuel. This control space is typically connected to the high pressure region of the fuel via a feed throttle. This control space furthermore has a small closable discharge throttle from which the fuel can escape. If it does so, the pressure in the control space and the closure force acting on the jet needle is reduced. A movement of the jet needle is thereby produced that releases the outlet opening at the injector tip. The servo valve here comprises the feed throttle, the control space, and also the discharge throttle. To now be able to control the movement of the jet needle, the discharge throttle of the control space is selectively opened or closed with the aid of an electromagnetic valve or of another suitable valve. The pressure in the control space of the valve is determined by the controlled opening of this discharge throttle in combination with the feed throttle. This pressure is then responsible, as briefly explained above, for the opening and closing of the jet needle.

To end the injection and to hold the discharge throttle of the valve closed between the injections, a certain spring force is required that presses a closure member (also called an armature in technical language) against the discharge throttle to prevent the discharge of fuel from the discharge throttle and in so doing to prevent the reduction of pressure in the control space. For the opening, in contrast, the set spring force at which the closure member is pressed against the sealing position of the discharge throttle has to be overcome so that the closure member releases the discharge throttle as quickly as possible. Typical required switch-on times, that is, the time from the start of the energization up to the abutting of the closure member at an upper stroke limit of such solenoid valves, are in the range of approximately 200 microseconds.

It is the objective of the present invention here to optimize the opening and closing of the jet needle independently of one another.

The invention does this by a device for controlling an injector. This device for controlling an injector here has a passage space that is closable by an armature element (=closure member) at one of its two sides to thus selectively separate a high pressure region from a low pressure region of the injector; a control space for applying a variable pressure; an injector component, preferably an injector needle (=jet needle); a valve that is arranged between another one of the two sides of the passage space and the control space; a first connection that connects the high pressure region of the injector to the passage space; and a second connection that connects the passage space to the control space. The device here is characterized in that the valve is adapted to establish a direct connection between the high pressure side and the control space when the pressure level in the passage space is equal to or greater than a predetermined value or when a specific ratio of the pressure in the control space to the pressure in the passage space is fallen below.

The valve described herein can here be the servo valve looked at in more detail in the introductory part of the description.

In accordance with the prior art, a pressure drop occurs in the passage space after the opening of the closure member, that is, of the armature element, since the highly pressurized fluid (=fuel) exits the passage space via the discharge throttle in the direction of a low pressure region. An outflow of highly pressurized fluid from the control space in the direction of the passage space thus also occurs due to the second connection that connects the passage space to the control space so that the force acting on the injector component is reduced due to the pressure decrease. If the closure member is then again brought into sealing contact with the discharge throttle of the passage space, a suppression of the outflow of fuel takes place. The fuel then flows at high pressure with the aid of the first connection from the high pressure region into the passage space so that a pressure increase takes place herein. The control space is here likewise flooded with highly pressurized fuel with the aid of the second connection so that the force acting on the injector component (for example the jet needle) increases and results in a closing of the injector.

In contrast to this, the valve of the present invention reacts differently. When a certain pressure in the passage space is exceeded or when a specific ratio of a pressure in the passage space to a pressure in the control space is exceeded, with the pressure increasing in the closed passage space through the feed via the first connection, the valve is adapted to establish a direct connection between the high pressure region of the fuel and the control space. It thereby becomes possible to fill the control space faster with the highly pressurized fluid (=fuel) so that an output of fuel by the injector is suppressed particularly abruptly and fast by the movement of the injector component. The injection amount of the fuel can thus be determined better since the transition phase of the injector from an open state to a closed state in which no fuel is output by the injector takes place faster.

The direct connection between the high pressure region and the control space preferably does not take place via the passage space here. The direct connection is therefore rather a coupling of the highly pressurized fuel to the control space.

In accordance with an optional modification of the invention, the first connection is provided with the aid of a feed throttle that represents a restricted connection from the passage space to the high pressure region of the injector, with this connection preferably being present independently of a state of the valve.

If the passage space is not closed, that is, the armature element is not set to an opening of the passage space, highly pressurized fluid (such as the fuel) escapes in the direction of the low pressure region released by the armature element so that a continuous inflow through the feed throttle also cannot counteract a pressure reduction in the passage space or in the control space in such a state.

In accordance with a further development of the present invention, the valve is further adapted only to establish the direct connection between the high pressure region and the control space when the pressure level in the passage space is equal to or greater than a predetermined value, whereas otherwise this connection is closed.

The direct connection between the high pressure region of the injector and the control space is therefore only realized by the valve when a specific pressure level has been reached in the passage space. If the pressure level in the control space has approximated that of the passage space due to the connection of the control space to the high pressure region, the valve is optionally adapted to close the direct connection again.

Provision can thus likewise be made that the valve is adapted to establish a direct connection between the high pressure side and the control space when the pressure level in the passage space is equal to or greater than a predetermined value with this predetermined value being based on a difference of the pressures between the passage space and the control space. Provision can thus be made, for example, that the valve establishes the direct connection when the pressure in the passage space is greater than a pressure present in the control space.

In accordance with a further optional invention, the second connection is a restricted connection and/or the direct connection is an unrestricted connection. A restricted connection is understood such that the flow of a fluid flowing through such a line is inhibited such that a pressure equalization over such a restricted connection takes a certain time. In contrast, with an unrestricted connection, it is assumed that no flow obstacles for the fluid are present in order not to prevent a pressure equalization of the fluid via such a connection.

Provision can preferably be made that the valve comprises a valve guide arranged between the other of the two sides of the passage space and the control space and a valve core that is displaceably supported in the valve guide. In this respect, the valve guide has a channel that does not establish a direct fluid connection between the high pressure region and the control space in a first position of the displaceable valve core in the valve guide and establishes a direct connection between the high pressure region and the control space in a second position of the displaceable valve core in the valve guide. There is accordingly no direct connection between the high pressure region and the control space in the first position of the valve core. A particularly simple implementation of the valve is thus achieved.

In accordance with a further development of the invention, the valve core moves at least temporarily into the second position on exceeding a predetermined pressure level in the passage space, whereby the two control spaces are separated.

Provision can furthermore be made that the valve core moves into the first position on a falling below of a predetermined pressure level in the passage space. Provision can likewise be made that the valve core moves into the first position when a pressure difference between the passage space and the control space falls below a predefined value. The valve core can thus, for example, be moved into the first position at a higher pressure in the control space with respect to a pressure level in the passage space. The moving of the valve core advantageously takes place automatically by the different pressures applied in the control space and in the passage space since they exert a specific force on the valve core on the respective side of the valve core (side in the passage space or side in the control space) and a displacement in one direction can be carried out in accordance with the pressure levels present in connection with the effective pressure-loaded surface of the valve core.

Provision can likewise be made in accordance with the invention that it furthermore has an abutment element that limits the stroke of the valve core on a movement from the first position into the second position. It is thereby possible to design the manufacturing tolerances at the elements more generously and to lower the costs of the claimed device overall. In addition, the abutment element restricting the stroke of the valve core effects the advantageous circumstance according to which the return path of the valve core into the first position is reduced so that the activation of the valve can be achieved faster on the next injection.

In accordance with an optional further development of the invention, the abutment element is furthermore a disk-shaped member that has one or more passage openings.

Provision can furthermore be made here that the abutment element is fastened, preferably welded, to the valve guide.

It is additionally possible that the abutment element is arranged in the control space or is arranged at the side of the valve guide facing the control space.

The optional provision of at least one passage opening in the abutment element serves the flow of fuel toward the control space or toward the second connection.

In accordance with a further advantageous modification of the present invention, the device furthermore has a return element that applies a force to the valve core that urges the latter from the second position into the first position. The valve core is automatically returned back into the starting position of the first position after the injection due to such a return element. The valve core thereby does not first have to overcome the valve stroke, that is, the difference between the first and second positions, on the activation of the next injection so that the response time is shortened.

Provision can be made here that the return element is a resilient element, preferably a spring or a coil spring, that urges the valve core into the first position with a specific force. The resilient element is here preferably arranged at a side of the valve core facing the control space.

The valve is preferably a 3/2-way valve since, in comparison with the 2/2-way valves used in the prior art, it has an additional fuel channel in the high pressure region of the injector that has a direct fluid communication with the control space in a specific state of the valve.

BRIEF DESCRIPTION OF THE FIGURES

Further details, features, and advantages of the invention will be explained with reference to the following description of the Figures.

There are shown.

DETAILED DESCRIPTION

Figure 1:
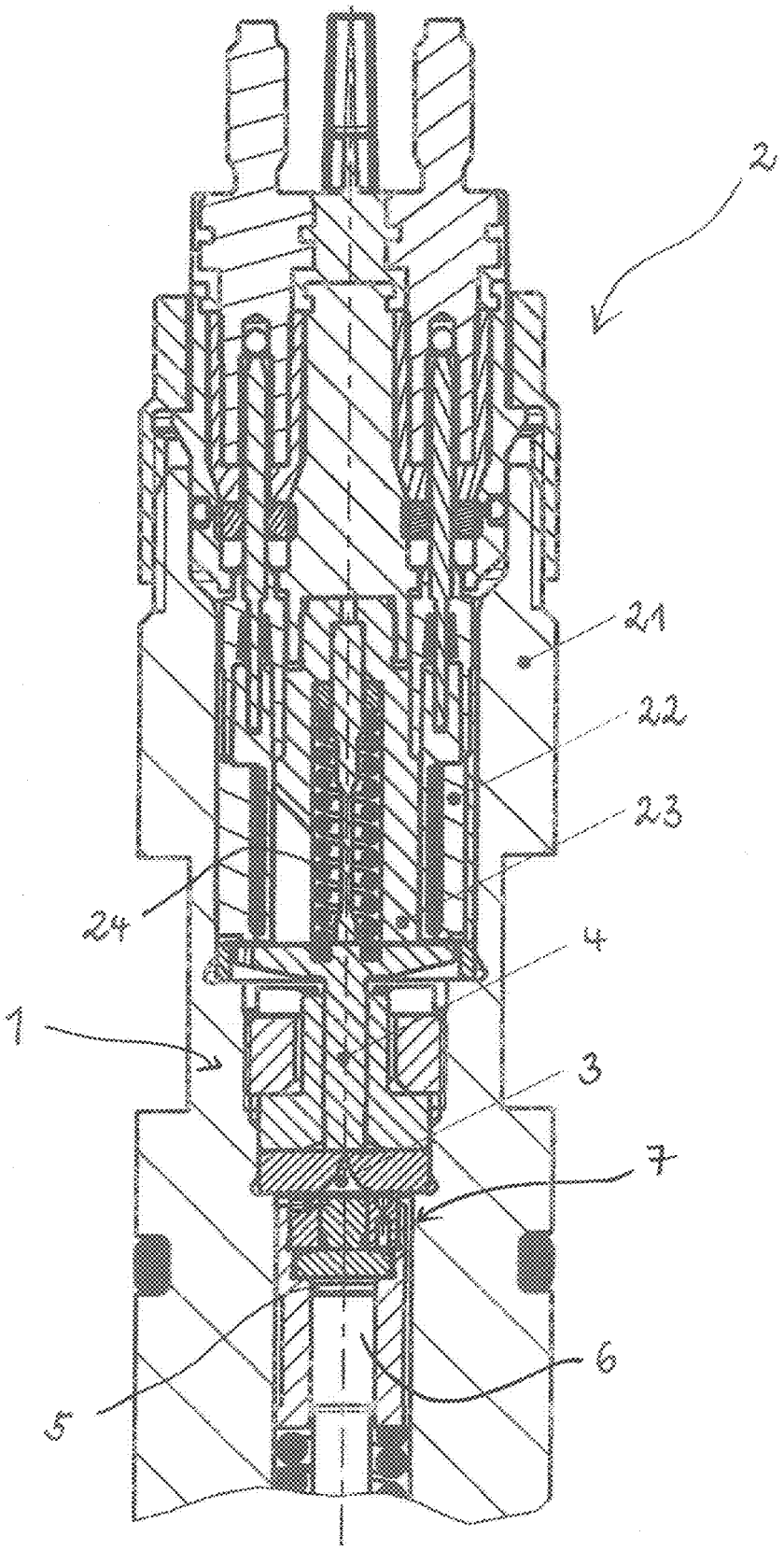
FIG. 1: a part of a schematic sectional representation of an injector with the device in accordance with the invention.

FIG. 1 shows a partial sectional representation of an injector 2. The movable injector needle 6 can be recognized that can be moved in the direction of the valve 7 arranged above it. If the injector needle 6 is moved toward the valve 7, an outflow of fuel occurs at the end of the injector that is not shown. In the other case in which the injector needle 6 is arranged at its position remote from the valve 7 no fuel flows out of the injector 2.

A control space 5 in which a variable pressure can be produced is located in direct proximity to the injector needle 6 between the valve 7. The passage opening 3 of the valve 7 adjoins directly the closure element or at the armature element 4 that can close the passage opening 3 in a fluidically sealed manner. A certain pressure that urges the armature element 4 in the direction of the passage opening 3 is required for this purpose. This is achieved with the aid of the spring cooperating with the armature element 4. If now the armature element should be raised from the passage opening 3 so that a pressure change occurs in the passage opening 3 or in the control space 5, a force pulling the armature element 4 away from the passage opening 3 is produced with the aid of an electromagnet. In this respect, an inner magnet pole 23 and an outer magnet pole 22 are provided in the injector housing 21 that together with a coil form an electromagnet for controlling the closure member.

Figure 2:
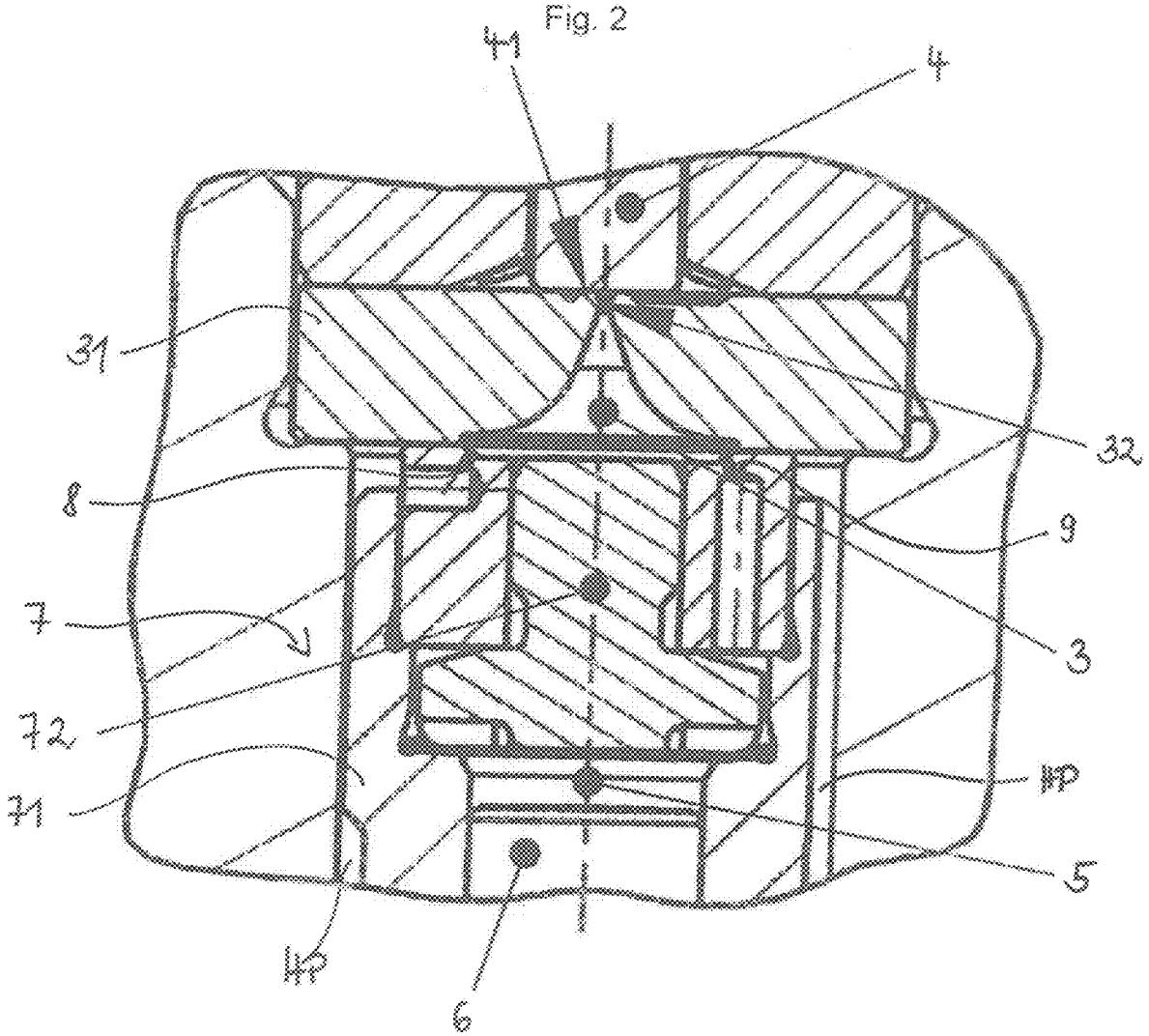
FIG. 2: an enlarged representation of the valve of the injector.

FIG. 2 shows an enlarged representation of the device 1 in accordance with the invention, in particular of the valve 7. Only the lower region of the armature element 4 can now be recognized that sealingly terminates a passage space 3 in a state acting in the direction of the valve, whereas the passage space 3 has fluid communication with the region surrounding the armature element 4 in an attracted state of the armature element 4. The seal seat 41 provides a sealing connection. A passage opening 32 is accordingly closed with the aid of the armature element 4. The passage space 3 furthermore has a feed throttle 8 that allows a highly pressurized fuel to flow into the passage space 3. There is furthermore a second throttle 9 that is called a discharge throttle 9 and that permits fluid communication with the control space 5. The valve core 72 is here arranged movable with respect to the valve guide 71. On an application of certain pressures in the control space 5 or in the passage space 3, the valve core 72 can accordingly be moved in the direction toward or away from the passage opening 3.

The present device in accordance with the invention or the function of the valve in accordance with the invention will be described with reference to FIGS. 3A-3D described in the following.

Figure 3A:
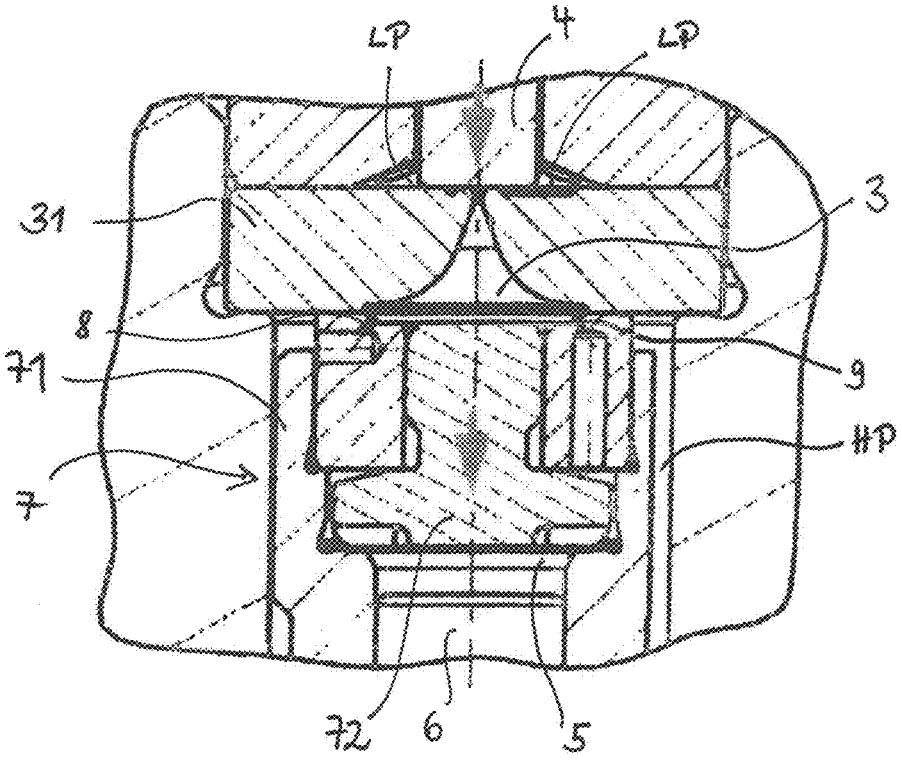
FIGS. 3A-3D: several states of the device in accordance with the invention during a work cycle of the injector.

FIG. 3A shows the state in which the pilot valve, that is, the opening of the armature element 4 with respect to the passage opening 3, and accordingly the injector 2, does not carry out any injection of fuel in a closed state. In the non-energized state of the electromagnet 22, 23, the passage opening 3, that can also be a bore, is closed by the closure member 4 (=armature element) with the aid of the bias of the compression spring 24 (cf. FIG. 1). The passage opening is provided in a so-called seat plate 31 here. In such a state, the armature element 4 separates the high pressure region HP from the lower pressure region of a fuel. The armature element 4 is attracted and the passage opening 3 in the seat plate 31 released by the control of the electromagnet 22, 23. The pressure beneath the seat plate 31 or within the passage opening 3 is thus lowered and the valve core 72 movably received in the valve guide 71 is drawn toward the lower edge of the valve guide 71. A fuel is furthermore supplied at a high pressure from the high pressure region via a feed throttle 8 to the passage region. The highly pressurized fuel runs via a further connection 9 to the control space 5 via the passage region 3. A very high pressure that acts on the injector needle 6 and ensures that the injector needle closes an outlet opening, not shown, is therefore present in the control space. The low pressure region LP of the fuel adopted here is accordingly separated from the high pressure region HP, that is now also in the passage space 3 and in the control space 5, with the aid of the armature element 4.

Figure 3B:
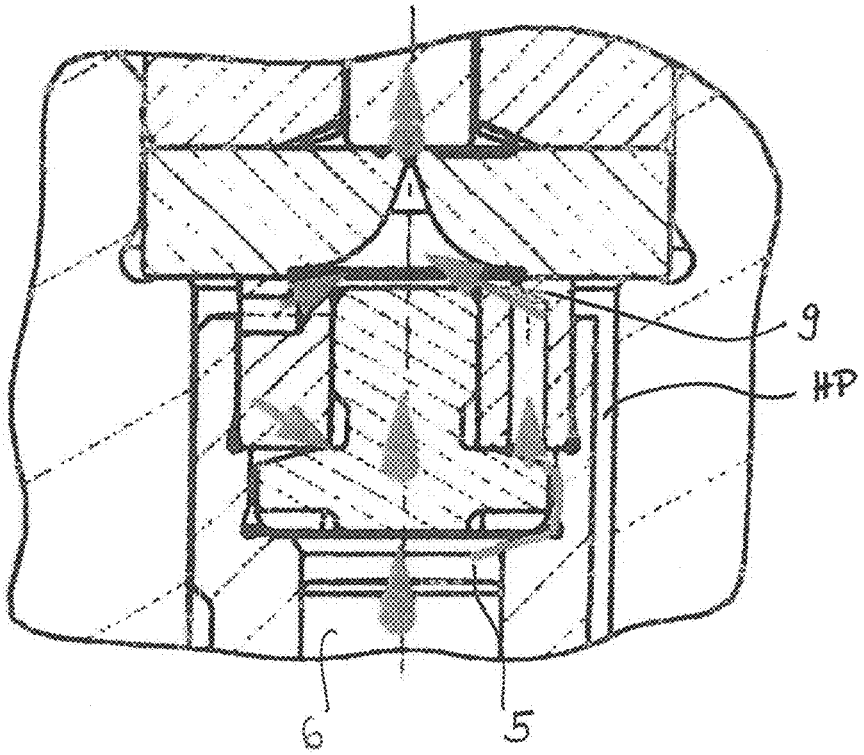

FIG. 3B shows a state in which the pilot valve is open and an injection is carried out by the injector 2.

An opening of the pilot valve signifies a raising of the armature element 4 so that fuel can flow out of the passage space 3 from the high pressure region HP toward the low pressure region LP. The raising of the armature element 4 accordingly makes possible direct fluid communication between the passage space 3 and the region surrounding the armature element 4. There is accordingly an outflow of fuel from the passage space 3 in the direction of the armature element 4. This also has the result that the fuel at a high pressure in the control space 5 flows through the discharge throttle 9 toward the low pressure region of the injector due to the existing pressure difference. This results in a pressure reduction above the injector needle 6 whereby the reduction of the pressure on the injector needle member 6 thus produced results in a raising of the injector needle 6 from its nozzle seat and an injection takes place.

In this respect, the feed throttle 8 and the discharge nozzle 9 as well as the passage space 3 are dimensioned such that the described procedures take place.

Figure 3C:
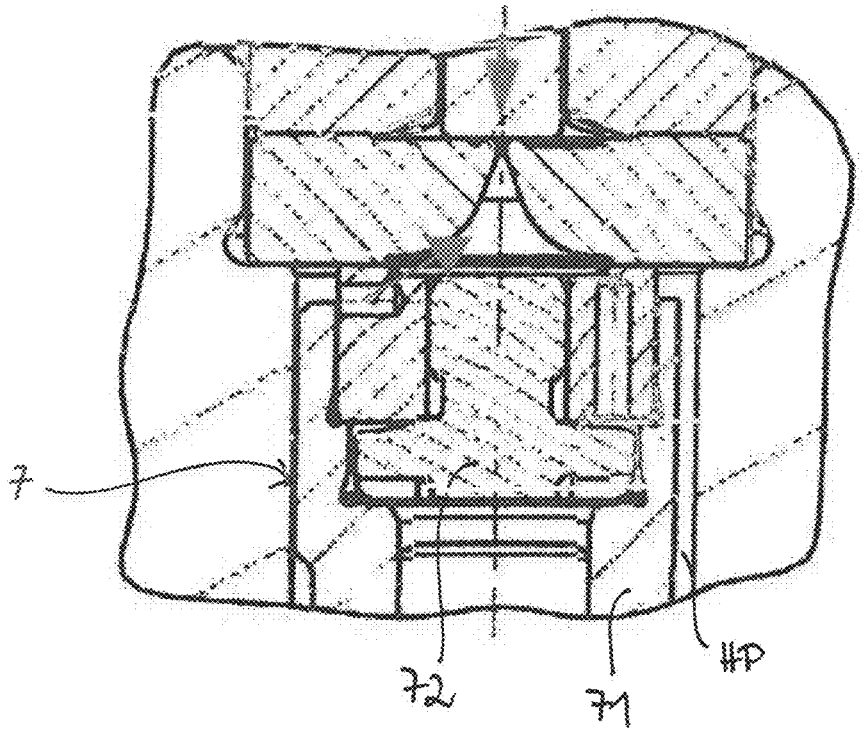

FIG. 3C shows the state in which the pilot valve is just closing and an injection of the injector 2 is still present.

As soon as the energization of the electromagnet 22, 23 is interrupted, the return spring 24 presses the armature element 4 back into a sealing seat on the seat plate 31 (cf. FIG. 1). Fuel can now no longer escape from the passage space 3 via the opening of the passage space 3 sealed by the armature element 4. The pressure above the valve core 72 is thus now increased due to the discharge throttle 8 that admits a specific quantity of highly pressurized fuel into the passage space 3.

Figure 3D:
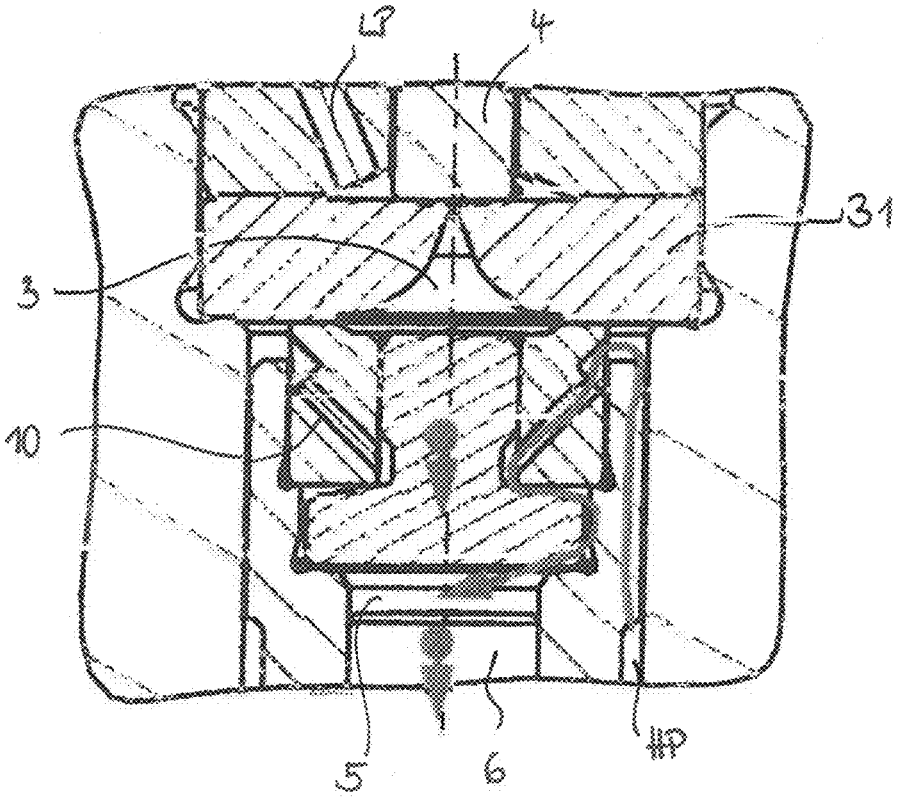

FIG. 3D shows a state in which the pilot valve is closed and the injector needle 6 closes and the injection of the injector 2 is ended.

FIG. 3D likewise shows a sectional view of the region discussed in FIGS. 3A-3C for this purpose, but a different sectional plane is shown in FIG. 3D to be able to show the features in accordance with the invention better. In the situation shown in FIG. 3D, the armature element has just been moved into a sealing position with respect to the opening of the passage space 3 so that now a highly pressurized fuel flows via the feed throttle 8 into the passage space 3. The pressure level thus therefore increases in the passage space 3 so that a movement of the valve core 72 away from the passage space 3 is produced due to the very high pressure in the passage space 3 compared with the control space 5. Due to this movement, a direct restriction-free connection is produced from the high pressure region HP of the fuel to the control space 5. This is done in the present case in that on the downwardly guided movement of the valve core 72, the supply channels 10 in the valve guide 71 establish fluid communication with the control space. This fluid communication is only produced due to the movement of the valve core 72 that has been effected due to the increased pressure in the passage space 3. A direction connection is thus produced between the high pressure volume in the injector 2 and the control space 5 above the injector needle 6 due to these bores 10.

The pressure in the control space 5 thus increases very quickly above the injector needle 6, which results in a particularly fast closing of the nozzle by the needle 6. It is now no longer necessary to wait for an inflow of the highly pressurized fuel from the passage space 3 via the throttle 9 into the control space 5. This is in particular of advantage since the geometry of the throttle 9 is optimized for an opening procedure so that both an opening procedure and a closing procedure can be optimized independently of one another by the present invention.

Figure 4:
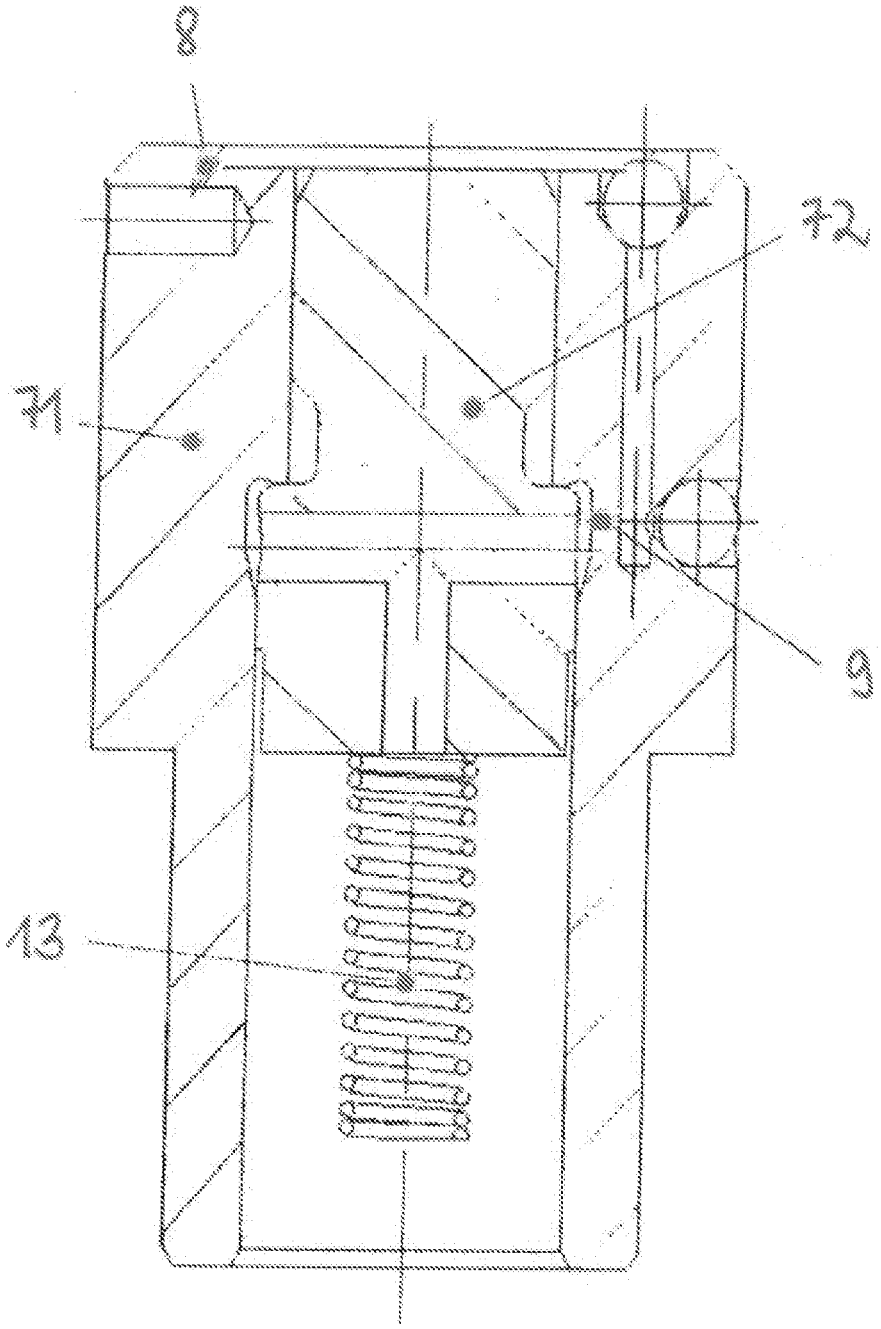
FIG. 4: a first embodiment of the valve.

FIG. 4 shows a sectional view of a further embodiment of the present invention.

Elements identical in their design or in their function are designated by the associated reference numerals of the above-described Figures. A coil spring 13 can be recognized that serves to return the valve core 72 back into the starting position after an injection. If therefore the pressure in the control space is equal to the pressure present in the high pressure region, the valve core 72, for instance, does not remain in the position in which there is fluid communication through the channel 10 provided in the valve guide, but is rather led back into its starting position with the aid of the spring 13. This brings along the advantage that the valve core 72 does not first have to overcome the valve stroke on the activation of the next injection and the response time of the injector is thereby shortened.

Figure 5:
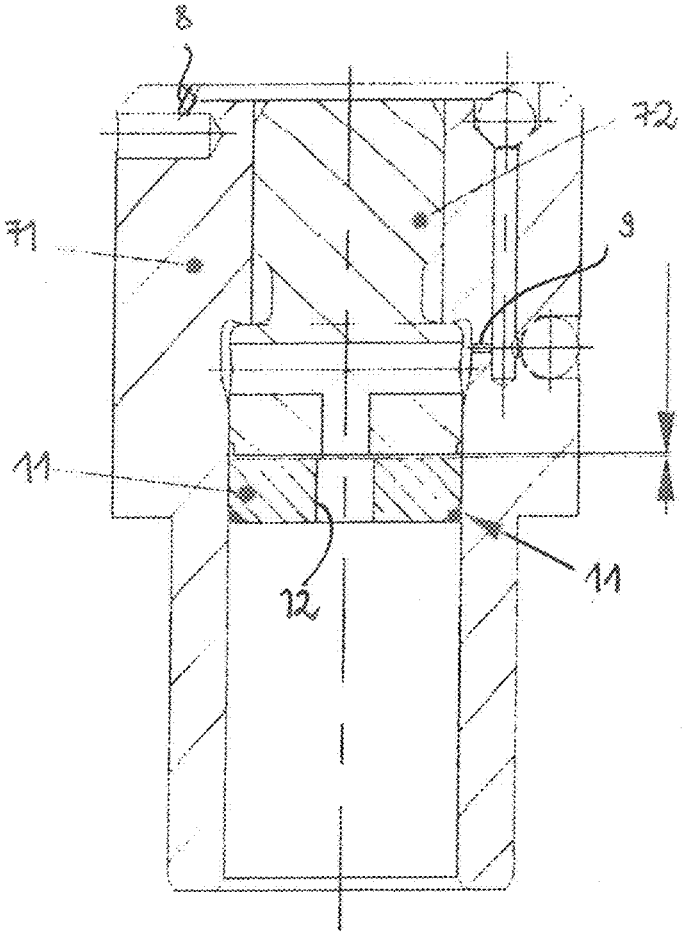
FIG. 5: a second embodiment of the valve.

FIG. 5 shows a further embodiment of the present invention in which an abutment element 11 in the form of a disk-shaped member is provided to bound the stroke of the valve core 72. The abutment element 11 is preferably fastened to the valve guide 71 with the aid of laser welding. The manufacturing tolerances at the elements can be designed more generously by the provision of the abutment element 11. The abutment element 11 furthermore has passage openings 12 that serve to allow fuel to flow through the abutment element 11.

Figure 6:
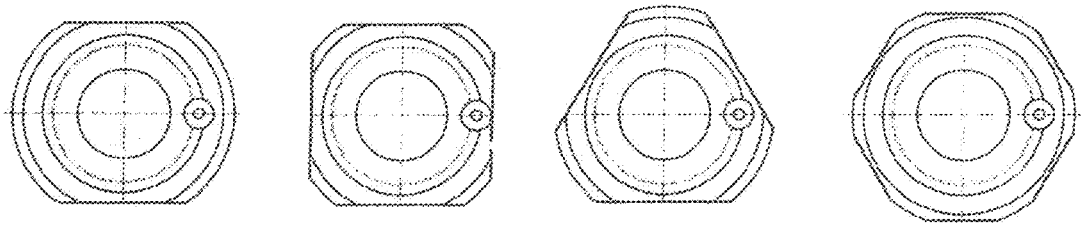
FIG. 6: several plan views of a plurality of possible implementations of the valve in a schematic representation.

FIG. 6 shows four different embodiments for the outer shape of the valve guide 71. If the latter is now led into a bore that adjoins flush with the circular outer sections of the valve guide 71, the flattened sections can serve to lead the fuel laterally past the sleeve.

Figure 7:
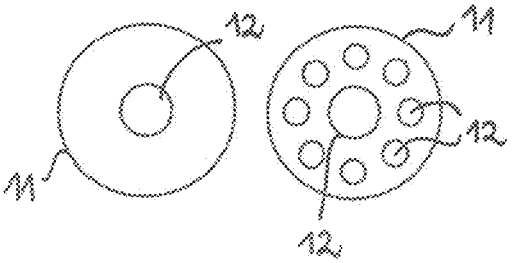
FIG. 7: several variants of an abutment element to restrict the stroke of a valve core.

FIG. 7 shows a plan view of two usable abutment elements 11 for bounding the stroke of the valve core 72. It can be recognized that each of the two abutment elements 11 has at least one passage opening 12.

The function of two elements (spring sleeve and valve guide) is combined in one element with the present invention. Provision can be made here that the blank of the valve 7 is preferably carried out as MIM (metal injection molding) and already has all the bores except for the discharge throttle 9 and the feed throttle 8 that are subsequently eroded.

A metal injection molding process is a production method in which a green compact is manufactured by means of an injection molding process and is subsequently completed by sintering in a furnace. Very complex element geometries can thereby be implemented inexpensively and the chipping at the element can be reduced to a minimum.

It can be recognized with reference to FIG. 5 that after a production of the discharge throttle 9, the lateral bore that is required to produce the throttle is closed with the aid of a laser welding process. The sphere shown in FIG. 5 and FIG. 4 should only indicate such a weld and is not installed in its actual size.

The invention claimed is:

1. A device for controlling an injector comprising:

a passage space that is closable by an armature element at one of two sides of the passage space to thus selectively separate a fluid high pressure region (HP) from a fluid low pressure region of the injector;

a control space for exerting a variable pressure on an injector component;

a valve that is arranged between another of the two sides of the passage space and the control space, the valve comprising:

a valve guide that is arranged between the other one of the two sides of the passage space and the control space; and a valve core that is displaceably supported in the valve guide, with the valve guide having a channel that runs from an outer circumferential surface of the valve guide to an inner circumferential surface of the valve guide, wherein the channel does not establish fluid communication between the high pressure region (HP) and the control space in a first position of the displaceable valve core in the valve guide and establishes fluid communication between the high pressure region (HP) and the control space in a second position of the displaceable valve core in the valve guide;

a first connection that connects the high pressure region (HP) of the injector to the passage space; and a second connection that connects the passage space to the control space, wherein, the valve is adapted to establish a direct connection between the high pressure region and the control space when the pressure level in the passage space is equal to or greater than a predetermined value.

2. The device in accordance with claim 1, wherein the direct connection does not take place via the passage space.

3. The device in accordance with claim 1, wherein the first connection is a feed throttle that represents a restricted connection of the passage space to the high pressure region (HP) of the injector.

4. The device of claim 3, wherein the first connection is independent of a state of the valve.

5. The device in accordance with claim 1, wherein the valve is further adapted only to establish the direct connection between the high pressure region and the control space when the pressure level in the passage space is equal to or greater than a predetermined value, and is adapted to otherwise close this connection.

6. The device in accordance with claim 1, wherein the second connection is a restricted connection and/or the direct connection is an unrestricted connection.

7. The device in accordance with claim 1, wherein the valve core is at least temporarily moved into the second position on an exceeding of a predetermined pressure level in the passage space and thus separates the control space and the passage space from one another.

8. The device in accordance with claim 1, wherein the valve core moves into the first position on a falling below of a predetermined pressure level in the passage space.

9. The device in accordance with claim 1, wherein the valve core moves into the first position when a pressure difference between the passage space and the control space falls below a predefined value.

10. The device in accordance with claim 1, wherein an abutment element that limits a stroke of the valve core on a movement from the first position into the second position is furthermore provided.

11. The device in accordance with claim 10, wherein the abutment element is a disk-shaped member that has one or more passage openings.

12. The device in accordance with claim 10, wherein the abutment element is fastened to the valve guide.

13. The device of claim 12, wherein the abutment element is welded.

14. The device in accordance with claim 10, wherein the abutment element is arranged in the control space.

15. The device in accordance with claim 1, furthermore having a return element that applies a force on the valve core that urges the valve core from the second position into the first position.

16. The device in accordance with claim 15, wherein the return element is a resilient element that urges the valve core into the first position with a specific force.

17. The device in accordance with claim 16, wherein the resilient element is a spring or a coil spring.

18. The device in accordance with claim 1, wherein the injector component is an injector needle.

19. The device of claim 1, wherein the passage space is centered over the valve core.

* * * * *